US006348664B2

(12) United States Patent
Kozuma

(10) Patent No.: US 6,348,664 B2
(45) Date of Patent: Feb. 19, 2002

(54) MULTIDIRECTIONAL SWITCH WHOSE STEM CAN BE TILTED AND PUSHED

(75) Inventor: Hiromichi Kozuma, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/866,103

(22) Filed: May 25, 2001

(30) Foreign Application Priority Data

Jun. 2, 2000 (JP) ..... 2000-170420

(51) Int. Cl.[7] ..... H01H 25/06
(52) U.S. Cl. ..... 200/6 A
(58) Field of Search ..... 20/4, 5 R, 6 A, 20/17 R, 18, 332, 335, 339; 345/157, 161; 463/36–38

(56) References Cited

U.S. PATENT DOCUMENTS 5,889,242 A 3/1999 Ishihara et al ..... 200/6 A
6,262,381 B1 * 7/2001 Kikuchi et al. ..... 200/6 A

FOREIGN PATENT DOCUMENTS

JP 10-188738 7/1998 ..... H01H/25/04

* cited by examiner

*Primary Examiner*—Michael Friedhofer
(74) *Attorney, Agent, or Firm*—Beyer Weaver & Thomas, LLP

(57) ABSTRACT

A multidirectional switch including a housing having disposed at an inside bottom portion thereof a central fixed contact, a common contact, and a plurality of peripheral fixed contacts; and a plurality of metallic movable contact springs disposed so as to oppose the central fixed contact and the peripheral fixed contacts, respectively. In the multidirectional switch, the movable contact springs are always in electrical conduction with the common contact, the movable contact springs being connected by a metallic connecting portion in order to form an integral structure. In addition, by operating an operating rod, at least one of the movable contact springs is brought into electrical conduction with the opposing central fixed contact or the corresponding one of the peripheral fixed contacts. Accordingly, the multidirectional switch makes it possible to prevent the movable contact springs from becoming displaced from their predetermined locations even if the multidirectional switch is tilted, and has the plurality of movable contact spring not separately but integrally formed, so that the number of component parts is reduced.

9 Claims, 9 Drawing Sheets

MULTIDIRECTIONAL SWITCH WHOSE STEM CAN BE TILTED AND PUSHED

BACKGROUND OF THE INVENTION

1. Field of the Invention

The present invention relates to a multidirectional switch which outputs a switching signal in accordance with the tilting direction of a stem, and, more particularly, to a multidirectional switch which outputs a switching signal even when a stem is pushed.

2. Description of the Related Art

A description of a conventional multidirectional switch will be given with reference to the relevant drawings.

FIG. 8 is a sectional view of a conventional multidirectional switch. FIG. 9 is a plan view of a housing of the conventional multidirectional switch. FIG. 10 is an exploded perspective view of movable contact springs and the housing of the conventional multidirectional switch. FIG. 11 illustrates the operation of the conventional multidirectional switch.

As shown in FIGS. 8 to 10, a housing 20 is molded out of a synthetic resin material, and comprises side walls 20*a* that surrounds four sides, an inside bottom portion 20*b* surrounded by the side walls 20*a*, four bosses 20*c* provided in a standing manner so as to extend outward from the four corners of the open end of the side walls 20*a*, four positioning portions 20*d* provided near the bosses 20*c*, and four inner protrusions 20*e* protruding from the inside bottom portion 20*b*.

At the inside bottom portion 20*b* of the housing 20 are exposed a circular central fixed contact 2, a common contact 3 which surrounds the periphery of the central fixed contact 2, and peripheral fixed contacts 4 disposed at four locations, at the front, back, left and right sides along the periphery of the common contact 3. The central fixed contact 2, the common contact 3, and the peripheral fixed contacts 4 protrude outwardly as terminals 5 from opposing side walls 20*a* of the housing 20. Here, the four protrusions 20*e* at the inside bottom portion 20*b* are provided in a standing manner so as to surround the circular central fixed contact 2.

A central tactile spring 60 serving as a central movable contact spring is formed by using a highly resilient base material, such as phosphor bronze or SUS, and subjecting the base material to surface treatment using silver (Ag). The central tactile spring 60 is dome shaped and is placed on the common contact 3 such that it is surrounded by the protrusions 20*e*.

Peripheral tactile springs 70 serving as peripheral movable contact springs are formed by using highly resilient base materials, such as phosphor bronze or SUS, and subjecting the base materials to surface treatment using silver (Ag). The peripheral tactile springs 70 are formed into rectangular shapes. A bulging portion 70*a* which is fixed on both sides is integrally formed at the center of its corresponding peripheral tactile spring 70. The peripheral tactile springs 70 are placed on the common contact 3, inwardly of each of the peripheral fixed contacts 4, and are positioned by the corresponding protrusions 20*e* and the inside walls of the housing 20.

In other words, the central tactile Spring 60, serving as a central movable contact spring, and each of the peripheral tactile springs 70, serving as a peripheral movable contact spring, are formed with different shapes, and are separately disposed inside the housing 20.

A first stem 8 is molded out of a synthetic resin material, and comprises a cylindrical portion 8*a*, a skirt 8*b*, and four semicircular protrusions 8*c*, which are integrally formed. The skirt 8*b* spreads obliquely downward from one end portion of the cylindrical portion 8*a*. Each semicircular protrusion 8*c* is formed at the bottom surface of the skirt 8*b* so as to be maintained at equal angular distances of approximately 90 degrees from each other. The protrusions 8*c* oppose the bulging portions 70*a* of their corresponding peripheral tactile springs 70.

A guide hole 9 is formed in the center portion of the cylindrical portion 8*a* so as to pass vertically therethrough.

Four protrusions 8*d* are integrally formed at the peripheral edge of the lower portion of the skirt 8*b*. These protrusions 8*d* extend outwardly from portions midway between corresponding two adjacent protrusions 20*e*, and engage the corresponding positioning portions 20*d* of the housing 20.

The first stem 8 is rockably supported with respect to the housing 20 by the peripheral tactile springs 70, which are placed on the inside bottom portion 20*b* of housing 20. The housing protrusions 20*e* have slots in a lower portion thereof (as best seen in FIG. 9) which hold the peripheral tactile springs 70 in place.

A second stem 10 is molded out of a synthetic resin material. A flange 10*a* is integrally formed at the bottom end of the second stem 10. The bottom surface of the flange 10*a* opposes the top surface of each of the protrusions 20*e* of the housing 20 so as to be maintained at a predetermined distance therefrom. The second stem 10 protrudes upward from the first stem 8 as a result of being inserted into the guide hole 9 from therebelow, and is stopped by the flange 10*a* so as not be dislodged from the first stem 8. A presser protrusion 10*b* is integrally formed at the center of the lower surface of the second stem 10. The bottom end of the presser protrusion 10*b* is in contact with the central tactile spring 60.

A cover 11 is formed of a metal plate by a pressing operation. A circular central hole 11*a* is formed in the center of the cover member 11, and mounting holes (not shown) are formed in the four corners thereof. A portion which widens in the downward direction is formed at the peripheral edge of the central hole 11*a*. With the skirt 8*b* of the first stem 8 being passed through the center hole 11*a*, the cover member 11 covers the open end of the top portion of the housing 20 by caulking the bosses 20*c* passed through their corresponding mounting holes (not shown).

In the multidirectional switch having the abovedescribed structure, the central tactile spring 60 and each of the peripheral tactile springs 70 are separately disposed inside the housing 20. The peripheral tactile springs 70 and the corresponding protrusions 8*c* are made to oppose each other with predetermined separations therebetween in order to provide a play therebetween. Therefore, in certain states of use of the switch, when, as shown in FIG. 11, the second stem 10 and the first stem 8 are rocked with respect to the housing 20 so that the entire multidirectional switch is tilted while in a switched state. In this configuration, one of the peripheral tactile springs 70*b* is compressed, while, the distance between the peripheral tactile spring 70*c* disposed opposite to the direction of operation of the first stem 8 and the corresponding protrusion 8*c* increases. Therefore, the peripheral tactile spring 70 may lift from the inside bottom portion 20*b* of the housing 20, causing the outside end of the peripheral tactile spring 70 to move upward along the corresponding side wall 20*a* of the housing 20. If the peripheral tactile spring 70 stays on the side wall 20*a* when the multidirectional switch is tilted back to its original position (as will sometimes occur), the switching of the peripheral tactile spring 70 may be hindered.

In the above-described multidirectional switch, in order to always cause each of the peripheral tactile springs and the central tactile spring to be in electrical conduction with the common contact, it is necessary to wire the common contact so as to surround the central tactile spring. This has prevented size reduction of the multidirectional switch in the widthwise direction.

In addition, a large number of tactile springs are used, and the assembly operations are troublesome to carry out, so that the multidirectional switches cannot be provided at low costs.

SUMMARY OF THE INVENTION

To achieve the foregoing and other objects of the invention a multidirectional switch is provided that includes a housing having disposed at an inside bottom portion thereof a central fixed contact, a common contact, and a plurality of peripheral fixed contacts. A plurality of metallic movable contact springs are positioned to oppose the central fixed contact and the peripheral fixed contacts, respectively. The movable contact springs are connected together and are also in electrical communication with the common contact.

An actuator assembly (e.g., an operating rod) is arranged permit any selected one of the movable contact springs to be brought into electrical communication with its opposing fixed contact.

In one form of the present invention, the movable contact springs are integrally formed from a metallic material. In some implementations they are dome-shaped.

In another form of the present invention, the housing is substantially rectangular in shape and the plurality of peripheral fixed contacts are disposed at the four corners of the housing in still another form of the present invention, the movable contact springs comprise a central movable contact spring disposed so as to oppose the central fixed contact, and peripheral movable contact springs disposed so as to oppose the corresponding peripheral fixed contacts. In this form of the multidirectional switch, a pair of the connecting portions that oppose each other extend from an outer peripheral edge of the central movable contact spring. In addition, connecting portions are provided, one branching and extending from each connecting portion, with the peripheral movable contact springs being connected at ends of the branched connecting portions.

In still another form of the present invention, the operating rod comprises a first stem which has a guide hole formed in the center thereof and which is rockably supported with respect to the housing, and a second stem which is slidably fitted to the guide hole and which protrudes from the first stem. In this form of the multidirectional switch, by tilting the first stem in a predetermined direction through the second stem, a desired one of the peripheral fixed contacts is brought into electrical conduction with the common contact through the corresponding movable contact spring and the connecting portion. In addition, by pushing the second stem, the central fixed contact is brought into electrical conduction with the common contact through the corresponding movable contact spring.

DESCRIPTION OF THE PREFERRED EMBODIMENT

Hereunder, a description of an embodiment of a multidirectional switch in accordance with the present invention will be given with reference to the relevant drawings.

Figure 1:
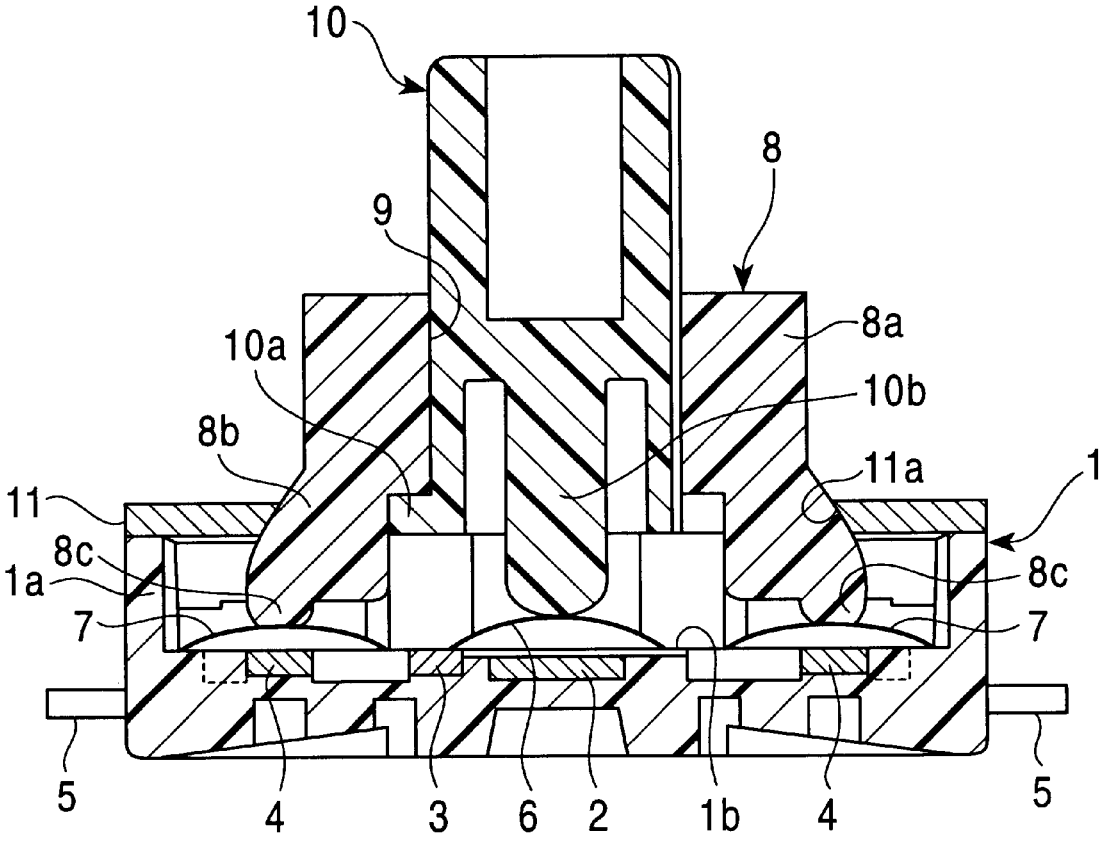
FIG. 1 is a sectional view of an embodiment of a multidirectional switch in accordance with the present invention.
Figure 2:
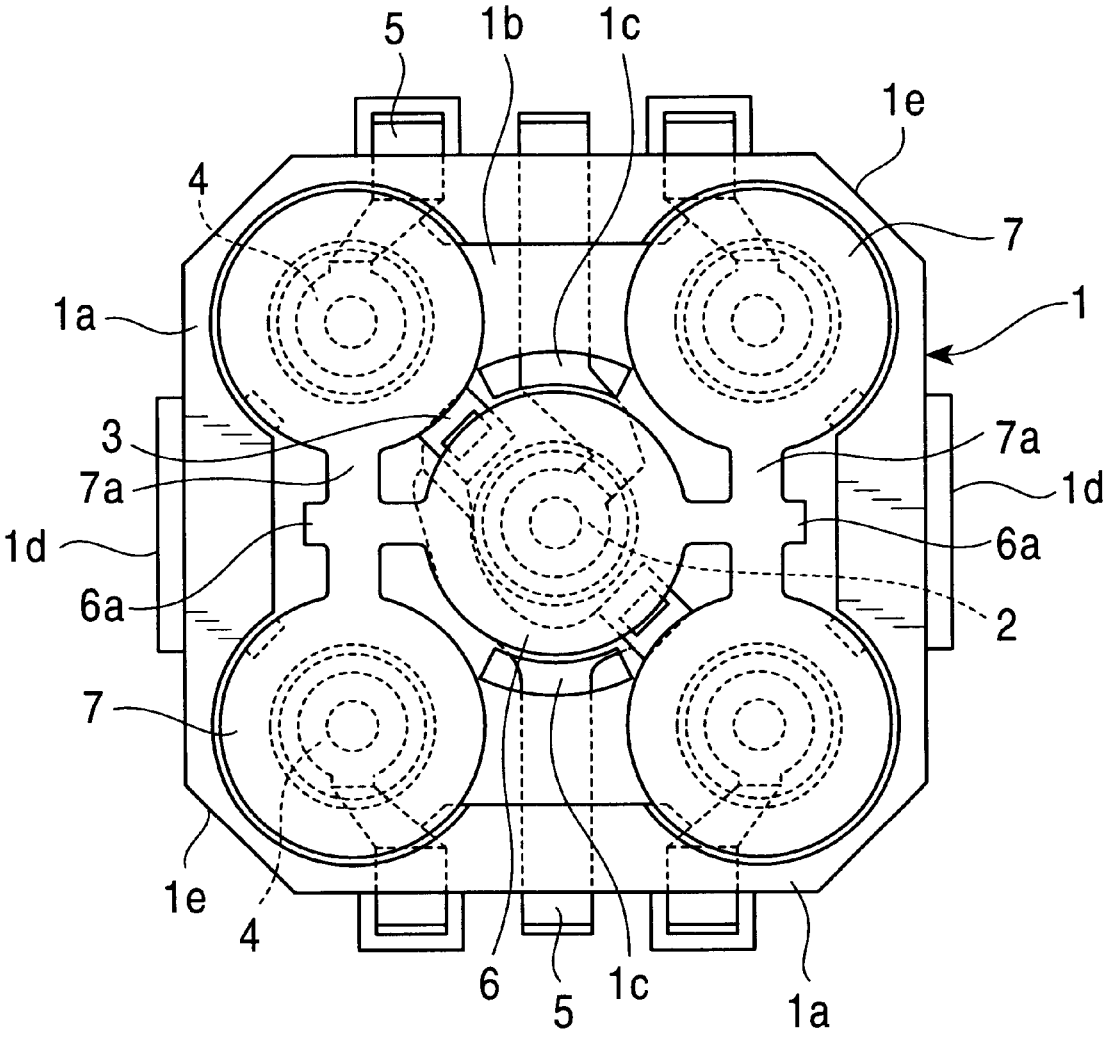
FIG. 2 is a plan view of a housing of the embodiment of the multidirectional switch in accordance with the present invention.

FIG. 1 is a sectional view of an embodiment of a multidirectional switch in accordance with the present invention. FIG. 2 is a plan view of a housing of the embodiment of the multidirectional switch in accordance with the present invention.

As shown in FIGS. 1 and 2, a housing 1 is molded out of a synthetic resin material into a substantially rectangular shape. The housing 1 comprises side walls 1*a* which surround four sides, an inside bottom portion 1*b* which is surrounded by the side walls 1*a*, two opposing protrusions 1*c* which protrude from the inside bottom portion 1*b*, and protrusions 1*d*, each of which protrudes outwardly from its corresponding side wall 1*a* of a pair of the opposing side walls 1*a*. Planar walls 1*e* are formed at the four corners of the side walls 1*a* by what is called chamfering.

At the inside bottom portion 1*b* of the housing 1 are exposed a circular central fixed contact 2, common contacts 3 disposed at opposing portions along the periphery of the central fixed contact 2, and four circular peripheral fixed contacts 4 disposed at the front, back, left, and right sides along the periphery of the central fixed contact 2. The central fixed contact 2, the common contacts 3, and the peripheral fixed contacts 4 protrude outwardly as terminals 5 from opposing side walls 1*a* of the housing 1. Here, the two protrusions 1*c* at the inside bottom portion 1*b* are provided in a standing manner so as to surround the circular central fixed contact 2.

The central fixed contact 2 is disposed at the center portion of the inside bottom portion 1*b*. The four peripheral fixed contacts 4 disposed at the front, back, left, and right sides along the periphery of the central fixed contact 2 are disposed at locations opposing the planar walls 1*e* of the housing 1, that is, at the four corners of the housing 1.

A central tactile spring 6 serving as a central movable contract spring is formed by using a highly resilient metallic material as a base material, such as phosphor bronze or SUS, and subjecting the base material to surface treatment using silver (Ag). The central tactile spring 6 comprises a skirt which rises from the peripheral portion to the apex at a predetermined angle, and an invertible bulging portion formed continuously with the skirt and having its apex formed into a dome shape. The central tactile spring 6 is placed on the common contacts 3 formed along the periphery of the central fixed contact 2, is in electrical conduction with the common contacts 3, and is positioned at the inside surface of each of the protrusions 1*c*. In this state, the central tactile spring 6 is disposed so as to oppose the central fixed contact 2.

Peripheral tactile springs 7 serving as peripheral movable contact springs are formed by using resilient metallic materials, such as phosphor bronze or SUS, as base materials, and subjecting the base materials to surface treatment using silver (Ag). Each peripheral tactile spring 7 comprises a skirt which rises at a predetermined angle from the peripheral edge to the apex thereof, and an invertible bulging portion formed continuously with its skirt and having its apex formed into a dome shape. The peripheral tactile springs 7 are disposed at the four corners of the housing 1, respectively. In this state, the peripheral tactile springs 7 are disposed so as to oppose their corresponding peripheral fixed contacts 4.

The central tactile spring 6 and the peripheral tactile springs 7 are connected together by metallic connecting portions 6*a* and metallic connecting portions 7*a*. By punching out the same hoop material of which the central tactile spring 6 and the peripheral tactile springs 7 are made, in order not to reduce the feel of the inverting operation of the tactile springs, the connecting portions 6*a* and the connecting portions 7*a* are integrally formed so that the central tactile spring 6 and the peripheral tactile springs 7 are joined at the skirt of the central tactile spring 6 and the skirts of the corresponding peripheral tactile springs 7. The connecting portions 6*a* extend outwardly from opposing sides of the outer peripheral edge of the central tactile spring 6. The connecting portions 7*a* extend in a direction perpendicular to the connecting portions 6*a* from the connecting portions 6*a* in order to connect the peripheral tactile springs 7 at the ends thereof.

In other words, the central tactile spring 6 and the peripheral tactile springs 7 are integrally formed by the connecting portions 6*a* and the connecting portions 7*a*.

The shapes of the central tactile spring 6 and the peripheral tactile springs 7 are not limited to the aforementioned shapes, so that they may be, for example, rectangular. However, when the invertible bulging portions are formed by drawing, and the connecting portions are formed by pressing plate materials, it is preferable that the central tactile spring 6 and the peripheral tactile springs 7 be formed in dome shapes because the operations can then be stably carried out.

A first stem 8 serving as an operating rod is molded out of a synthetic resin material, and comprises a cylindrical portion 8*a*, a skirt 8*b*, and four semicircular protrusions 8*c*, which are integrally formed with each other. The skirt 8*b* spreads obliquely downward from one of the ends of the cylindrical portion 8*a*. Each of the protrusions 8*c* is formed at the bottom surface of the skirt 8*b* so as to be maintained at equal angular distances of approximately 90 degrees. The protrusions 8*c* substantially oppose the domeshaped apexes of the corresponding peripheral tactile springs 7.

A guide hole 9 is formed in the center of the cylindrical portion 8*a* so as to pass therethrough vertically. The first stem 8 is rockably supported with respect to the housing 1.

A second stem 10 serving as an operating rod is molded out of a synthetic resin material, and comprises a flange 10*a* integrally formed at the lower end of the second stem 10. The second stem 10 protrudes upward from the first stem 8 as a result of being inserted into the guide hole 9 from therebelow, and is stopped by the flange 10*a* so as not to be dislodged from the first stem 8. A presser protrusion 10*b* is integrally formed at the center of the lower surface of the second stem 10. The bottom end of the presser protrusion 10*b* is in contact with substantially the apex of the central tactile spring 6.

A cover 11 is formed of a metal plate by a pressing operation. A circular central hole 11*a* is formed in the center of the cover member 11. A portion which widens in the downward direction is formed at the peripheral edge of the central hole 11*a*. With the skirt 8*b* of the first stem 8 being passed through the center hole 11*a*, the cover member 11 covers the open end of the top portion of the housing 1 by a suitable means, such as a snap-in method.

A description of the operation of the multidirectional switch of the present invention will now be given with reference to the relevant drawings.

Figure 3:
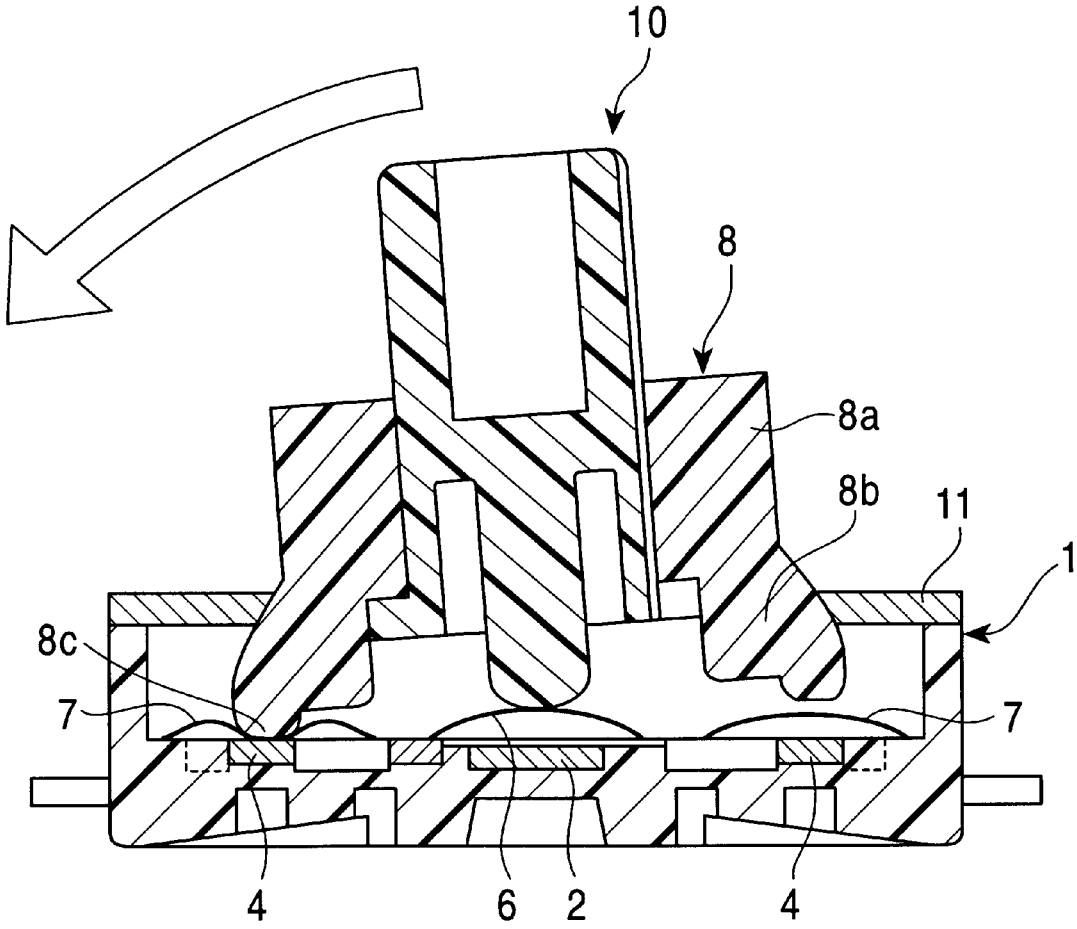
FIG. 3 is a sectional view showing a tilting operation of the multidirectional switch in accordance with the present invention.
Figure 4:
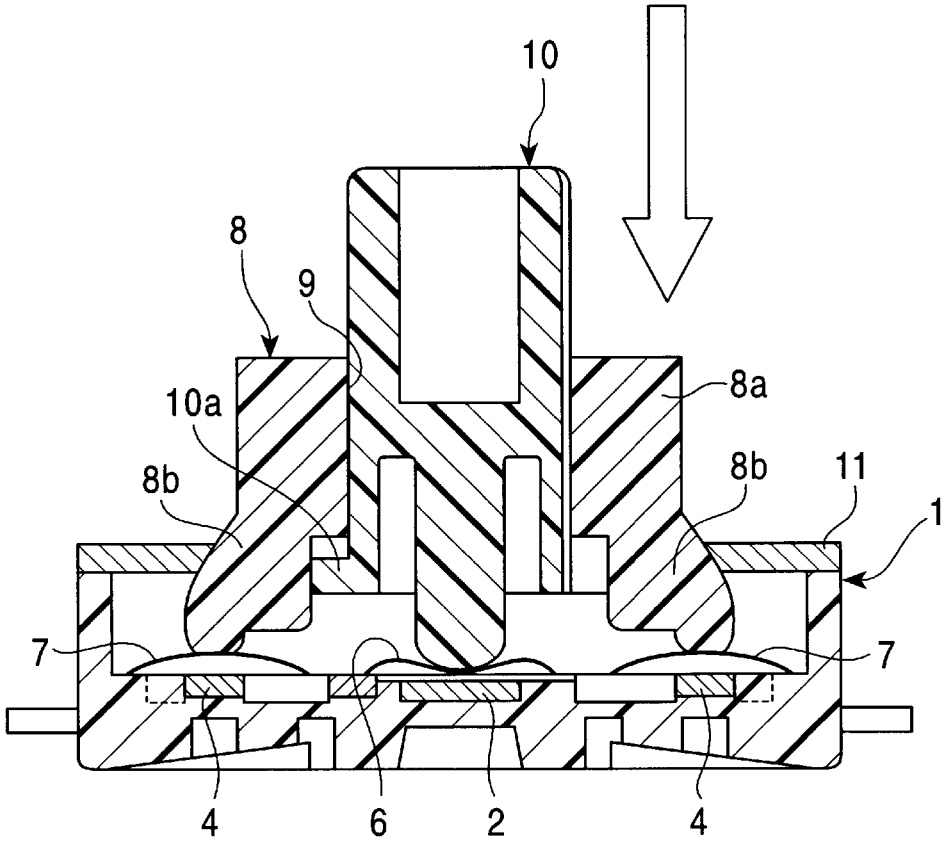
FIG. 4 is a sectional view showing a pushing operation of the multidirectional switch in accordance with the present invention.

FIG. 3 is a sectional view showing a tilting operation of the multidirectional switch in accordance with the present invention. FIG. 4 is a sectional view of a pushing operation of the multidirectional switch in accordance with the present invention.

As shown in FIG. 3, the second stem 10 is tilted in any one of the four directions, towards the front, back, left or right, where each of the peripheral fixed contacts 4 is disposed. For example, when the second stem 10 is tilted towards the left peripheral fixed contact 4 as indicated by the arrow shown in FIG. 3, the first stem 8 tilts along with the second stem 10 in this direction. This causes the protrusion 8*c* disposed in the tilting direction to push the peripheral tactile spring 7 (that is, the peripheral movable contact spring) disposed below this protrusion 8*c*. When the operator experiences a tactile feel as a result of this peripheral tactile spring 7 being inverted, the corresponding peripheral fixed contact 4 and the corresponding common contact 3, both of which are disposed below this peripheral tactile spring 7, are brought into electrical conduction with each other through the corresponding peripheral tactile spring 7, the corresponding connecting portion 6*a* and the corresponding connecting portion 7*a* and the peripheral tactile spring 7. This causes the switch to be turned on.

At this time, the tilting angle is restricted by the flange 10*a* of the second stem 10 coming into contact with the protrusion 1*c* of the housing 1. When the bottom surface of the flange 10*a* is in contact with the protrusions 1*c*, the second stem 10 does not tilt any further, thereby making it possible to reliably prevent the central tactile spring 6 from accidentally becoming inverted and coming into contact with the central fixed contact 2.

When the second stem 10 is tilted towards a portion midway between two adjacent peripheral fixed contacts 4, the two protrusions 8*c* disposed in the tilting direction push the corresponding pair of peripheral tactile springs 7 disposed therebelow. Therefore, the peripheral fixed contacts 4 and the common contact 3 disposed below the activated pair of peripheral tactile springs 7 are brought into electrical conduction with each other through the corresponding peripheral tactile springs 7, as a result of which the switch is turned on.

When the pushing force on the second stem 10 in the tilting direction is removed, the first stem 8 returns to its original position by the self-restoring force of the inverted peripheral tactile spring or springs 7. Since the second stem 10 returns to its original position along with the first stem 8, the switch is restored to its OFF state shown in FIG. 1. Here, since a portion which widens in the downward direction is formed at the peripheral edge of the central hole 11*a* of the cover 11, the first stem 8 can smoothly be restored to its original position.

Next, as shown in FIG. 4, when the second stem 10 is pushed downward in the direction of the arrow, the second stem 10 moves downward along the guide hole 9 in the first stem 8, causing the presser protrusion 10*b* to push the central tactile spring 6 (that is, the central movable contact spring) disposed therebelow. The operator will experience a tactile feel when the switch is turned on. More specifically, the inversion of the central tactile spring 6 presses the central tactile spring into contact with the fixed contact 2, thereby electrically coupling the central fixed contact 2 and the common contact 3.

At this time, the first stem 8 functions as a guiding member for the pushing operation of the second stem 10. When the directly downward pushing force on the second stem 10 is removed, the self-restoring force of the inverted central tactile spring 6 causes the second stem 10 to return to its original position, so that the switch is restored to its OFF state as shown in FIG. 1.

Accordingly, the multidirectional switch of the embodiment can be used to perform not only a total of eight switching operations (four switching operations performed to bring any one of a desired peripheral tactile springs 7 into electrical conduction with its corresponding peripheral fixed contact 4, and four switching operations performed to bring any two desired adjacent peripheral tactile springs into electrical conduction with the corresponding peripheral fixed contacts 4) by changing the tilting direction of the second stem 10, but also a switching operation performed to bring the central tactile spring 6 into electrical conduction with the central fixed contact 2 by pushing the second stem 10. In addition, when any one of these switching operations is performed, a tactile feel is obtained.

It should be appreciated that the peripheral tactile spring 7 disposed in a direction opposite to the tilting direction of the second stem 10 is integrally formed with the other peripheral tactile springs 7. Therefore, even when, while the multidirectional switch of the embodiment of the present invention is tilted, the second stem 10 is pressed in, the peripheral tactile springs 7 do not climb onto the walls of the housing. Therefore, switching operations can be reliably carried out.

It should be appreciated that the peripheral tactile springs and the central tactile spring are integrally formed and electrically connected by the connecting portions. Therefore, it is not necessary to provide a peripheral common contact for each tactile spring as required by the described prior art, which reduces the number of contacts that must be provided. Since the peripheral common contacts of the described prior art are positioned so as to surround the central tactile spring, their elimination also allows the wiring layout of the common contacts 3 to be planned with greater flexibility, thereby making it possible to reduce the size of the multidirectional switch in the widthwise direction thereof.

Although in the above-described embodiment, the common contacts 3 are disposed at two locations at an end of the skirt of the central tactile spring, they may be disposed at a wide variety of other locations since the central and peripheral tactile springs are electrically connected. By way of example, the common contacts 3 may be positioned to contact the connecting portions 6*a* or 7*a* or they may be such as to be brought into electrical communication with the peripheral tactile springs 7. Preferably, as in the embodiment, the locations which are brought into electrical conduction are provided at the central tactile spring, and the second stem 10 and the central tactile spring are made to always contact each other. Such a structure makes it possible to achieve stable contacting operations.

Since the plurality of tactile springs are integrally formed by the connecting portions, the number of component parts is reduced, and, during the assembly operation using an automatic assembling machine, the number of sucking operations that are carried out when a suction nozzle of the automatic assembling machine sucks the tactile springs is reduced, making it possible to reduce the number of man-hours required for the assembling operation.

A description of the movable contact springs of the multidirectional switch of the present invention will now be given.

Figure 5:
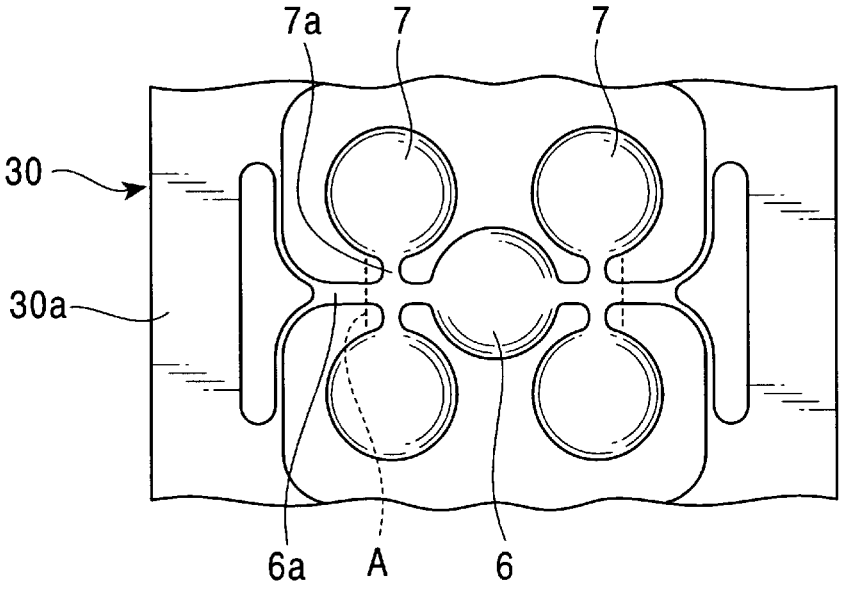
FIG. 5 is a first diagram for illustrating a first form of movable contact springs of the multidirectional switch in accordance with the present invention.

FIG. 5 is a first diagram for illustrating a first form of the movable contact springs of the multidirectional switch in accordance with the present invention.

As shown in FIG. 5, a highly resilient, metallic hoop material 30, such as phosphor bronze or SUS, is pressed in order to integrally form the central tactile spring 6, serving as a central movable contact, the four peripheral tactile springs 7, serving as peripheral movable contact springs, and the connecting portions 6*a* and the connecting portions 7*a*, which connect the central tactile spring 6 and each of the peripheral tactile springs 7 together. Here, the central tactile spring 6 and the peripheral tactile springs 7 are formed with the same dome shapes.

Here, the connecting portions 6*a* extend outward from opposite locations of the outer peripheral edge of the central tactile spring 6 (that is, locations separated by 180 degrees from each other), and the connecting portions 7*a* extend so as to branch from the sides of the connecting portions 6*a* that extend in the aforementioned manner and so as to cross the connecting portions 6*a*. The peripheral tactile springs 7 are connected at the ends of the connecting portions 7*a*. One of the ends of each of the connecting portions 6*a* located away from the central tactile spring 6 is integrally connected to a connecting portion 30*a* of the hoop material 30.

In this state, the hoop material 30, the central tactile spring 6, and each of the peripheral tactile spring 7 are cut/severed at a cut portion A in order to form a structure in which the central tactile spring 6 and each of the peripheral tactile springs 7 are integrally formed.

Figure 6:
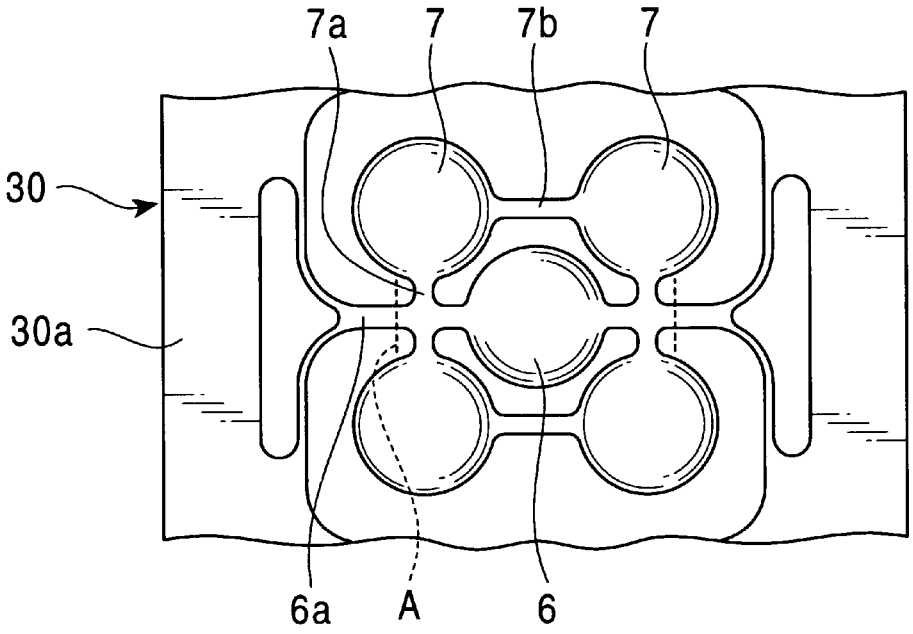
FIG. 6 is a second diagram for illustrating a second form of the movable contact springs of the multidirectional switch in accordance with the present invention.

FIG. 6 is a second diagram for illustrating a second form of the movable contact springs of the multidirectional switch in accordance with the present invention. Corresponding parts to those of the first form are given the same reference numerals and are not described below.

The second form differs from the first form in that in addition to the connecting portions 6*a* and connecting portions 7*a*, which connect the central tactile spring 6 and each of the peripheral tactile springs 7, connecting portions 7*b* that connect at least adjacent peripheral tactile springs 7 are provided.

By providing the connecting portions 7*b*, the adjacent peripheral tactile springs 7 are provided using two connecting portions 7*a* and two connecting portions 7*b*, so that they can be stably disposed.

Figure 7:
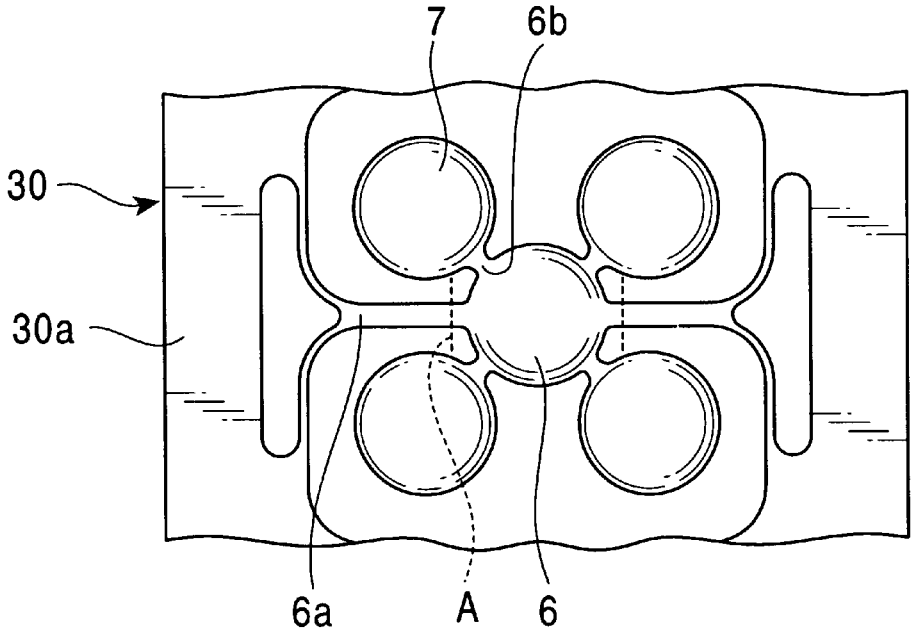
FIG. 7 is a third diagram for illustrating a third form of the movable contact springs of the multidirectional switch in accordance with the present invention.
Figure 8:
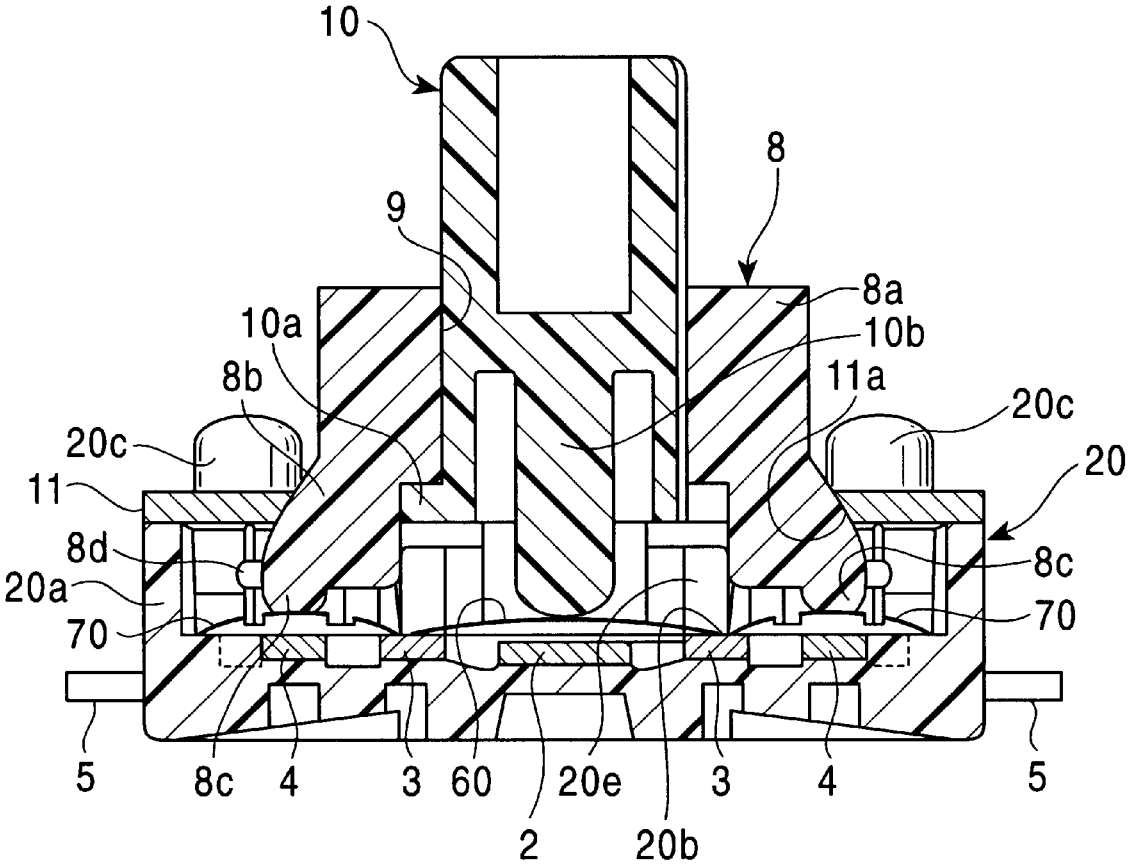
FIG. 8 PRIOR ART
FIG. 8 is a sectional view of a conventional multidirectional switch.
Figure 9:
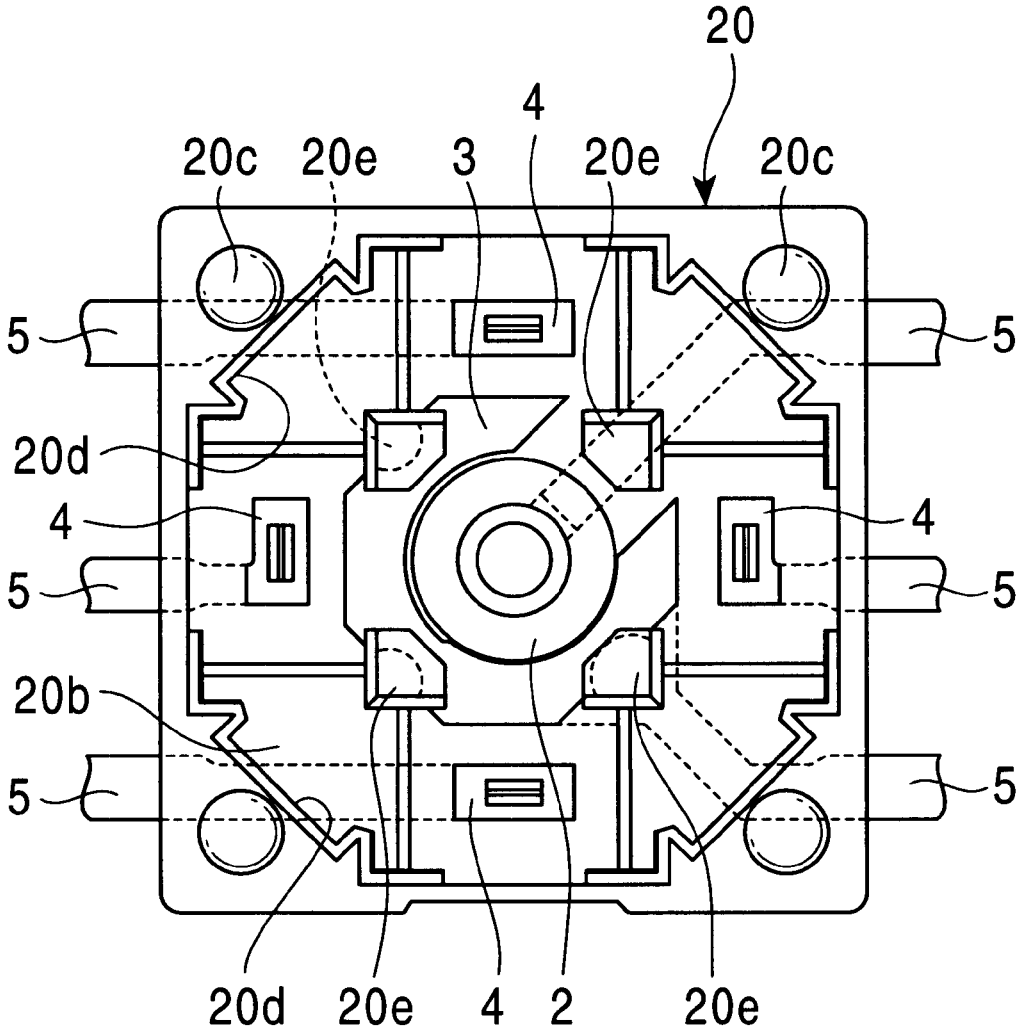
FIG. 9 PRIOR ART
FIG. 9 is a plan view of a housing of the conventional multidirectional switch.
Figure 10:
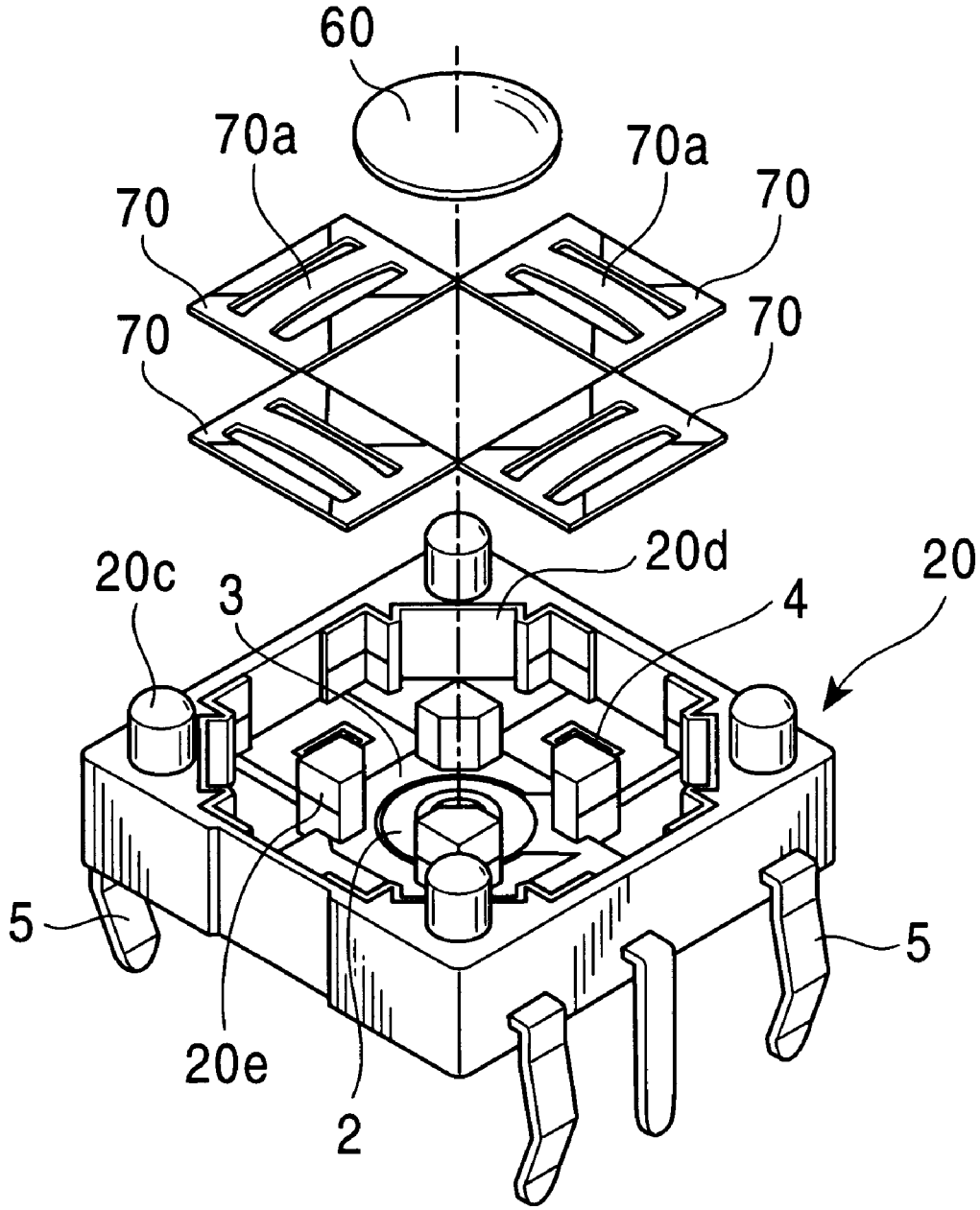
FIG. 10 PRIOR ART
FIG. 10 is an exploded perspective view of movable contact springs and the housing of the conventional multidirectional switch.
Figure 11:
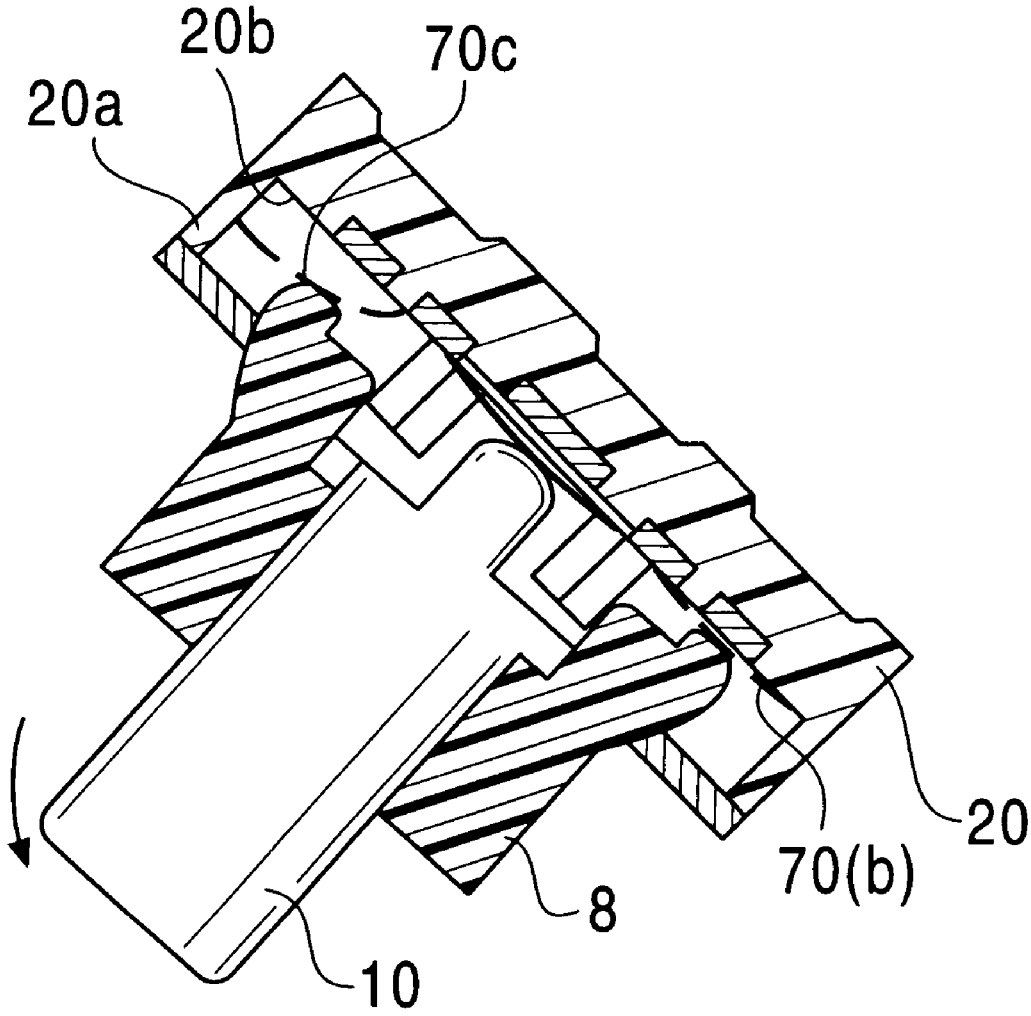
FIG. 11 PRIOR ART
FIG. 11 illustrates the operation of the conventional multidirectional switch.

FIG. 7 is a third diagram for illustrating a third form of the movable contact springs of the multidirectional switch in accordance with the present invention. Corresponding parts to those of the first and second forms are given the same reference numerals, and are not described below.

The third form differs from the first and second forms in that in addition to the connecting portions 6*a* that connect the central tactile spring 6 to the connecting portion 30*a* of the hoop material 30, connecting portions 6*b* that directly connect the central tactile spring 6 and each of the peripheral tactile springs 7 are provided. Accordingly, six connecting portions 6*a*, 6*b* extend from the central tactile spring 6.

Although in the above-described multidirectional switch, four peripheral movable contact springs that surround the central movable contact spring, serving as a movable contact spring, has been described, the present invention is not limited thereto, so that one or two or more peripheral movable contact springs can be obviously used.

As can be understood from the foregoing description, in the multidirectional switch of the present invention, the plurality of movable contact springs are connected by metallic connecting portions in order to form an integral structure, and are always in electrical conduction with the common contacts. By causing at least of one of the movable contact springs to be in electrical conduction with the opposing fixed contact or its corresponding peripheral fixed contact as a result of operating the operating rods, even if the multidirectional switch is used by tilting it, the at least one of the movable contact springs does not get displaced from a predetermined location because the movable contact springs are integrally formed with each other. Therefore, it is possible to obtain a multidirectional switch which can perform stable operations.

In addition, the number of component parts is reduced, so that a low-cost multidirectional switch can be obtained.

Further, since the plurality of movable contact springs are integrally formed so that they can be brought into electrical conduction, the layout of the locations that are brought into electrical conduction with the common contacts can be planned with greater flexibility.

Still further, since the number of locations that are brought into electrical conduction can be reduced, it is possible to obtain a multidirectional switch which can be reduced in size.

In the multidirectional switch of the present invention, the plurality of movable contact springs are dome-shaped springs having corresponding invertible bulging portions, and are integrally formed so that they can be separately inverted and restored to their original states through the corresponding connecting portions. Therefore, when a switching operation in a desired operating direction is carried out, a proper tactile feel can be obtained, and the movable contact springs can be easily formed. Consequently, a low-cost multidirectional switch can be obtained.

In the multidirectional switch of the present invention, by disposing the plurality of peripheral fixed contacts at the four corners of the inside bottom portion of the substantially rectangular housing, the peripheral fixed contacts can be disposed closer to each other compared to those of conventional multidirectional switches. Therefore, a smaller multidirectional switch can be obtained.

In the multidirectional switch of the present invention, by integrally forming the plurality of movable contact springs using a metallic hoop material by a drawing operation, the movable contact springs can be easily formed. Therefore, a low-cost multidirectional switch can be obtained.

In the multidirectional switch of the present invention, the central movable contact spring opposing the central fixed contact, and the peripheral movable contact springs opposing the corresponding peripheral fixed contacts are formed as movable contact springs. By causing a pair of opposing connecting portions to extend from the outer peripheral edge of the central movable contact spring, connecting portions to branch from the pair of connecting portions, and, by connecting the peripheral movable contact springs at the ends of the branched connecting portions, the peripheral movable contact springs are connected by one connector. Therefore, there is less restriction on the inverting/restoring operations of the peripheral movable contact springs. Consequently, the peripheral movable contact springs can be subjected to stable inverting/restoring operations. This makes it possible to provide a multidirectional switch which can perform stable operations.

In the multidirectional switch of the present invention, the operating rods comprise a first stem which has a guide hole formed in the center thereof and which is rockably supported with respect to a housing, and a second stem which is slidably fitted to the guide hole and which protrudes from the first stem. By tilting the first stem through the second stem in a predetermined direction, the desired peripheral fixed contact is brought into electrical conduction with the corresponding common contact through the corresponding movable contact spring and the corresponding connecting portion. By pushing the second stem, the central fixed contact is brought into electrical conduction with the corresponding common contact through the corresponding movable contact spring. Accordingly, by a tilting operation and a pushing operation, the contacts can be brought into electrical conduction. Therefore, it is possible to provide a multidirectional switch which performs reliable switching operations in multiple directions.

What is claimed is:

1. A multidirectional switch comprising:

a housing having disposed at an inside bottom portion thereof a central fixed contact, a common contact, and a plurality of peripheral fixed contacts; and a plurality of metallic movable contact springs disposed so as to oppose the central fixed contact and the peripheral fixed contacts, respectively;

wherein the movable contact springs are always in electrical communication with the common contact, the movable contact springs being connected by metallic connecting portions in order to form an integral structure; and wherein, by operating an operating rod, at least one of the movable contact springs may be brought into electrical communication with the opposing central fixed contact or the corresponding one of the peripheral fixed contacts.

2. A multidirectional switch according to claim 1, wherein the plurality of movable contact springs are domeshaped springs having invertible bulging portions, the plurality of movable contact springs being integrally formed so as to be separately invertible and restorable.

3. A multidirectional switch according to claim 1, wherein the housing is substantially rectangular in shape and the plurality of peripheral fixed contacts are disposed at four corners of an inside bottom portion of the housing.

4. A multidirectional switch according to claim 1, wherein the plurality of movable contact springs are integrally formed from a single metallic piece.

5. A multidirectional switch according to claim 1, wherein the movable contact springs comprise a central movable contact spring disposed so as to oppose the central fixed contact, and peripheral movable contact springs disposed so as to oppose corresponding ones of the peripheral fixed contacts, wherein a pair of the connecting portions that oppose each other extend from an outer peripheral edge of the central movable contact spring, and wherein branched connecting portions are provided, one branching and extending from each of the pair of connecting portions, with the peripheral movable contact springs being connected at ends of the branched connecting portions.

6. A multidirectional switch according to claim 1, wherein the operating rod comprises a first stem which has a guide hole formed in a center thereof and which is rockably supported with respect to the housing, and a second stem which is slidably fitted to the guide hole and which protrudes from the first stem, wherein, by tilting the first stem in a predetermined direction through the second stem, a desired one of the peripheral fixed contacts is brought into electrical conduction with the common contact through a corresponding one of the movable contact springs and the connecting portions, and wherein, by pushing the second stem, the central fixed contact is brought into electrical conduction with the common contact through a corresponding one of the movable contact springs.

7. A multidirectional switch comprising:

a housing having an inside bottom portion a central fixed contact;

a plurality of peripheral fixed contacts;

a metallic member having a plurality of moveable metallic contact springs integrally formed thereon, the contact springs each being positioned opposite an associated one of the fixed contacts;

at least one common contact in electrical communication with the metallic member thereby electrically connecting each of the contact springs with the common contact; and an actuator assembly arranged to permit any selected one of the movable contact springs to be brought into electrical communication with the opposing one of the fixed contacts.

8. A multidirectional switch according to claim 7, wherein the actuator assembly includes:

a first stem having a guide hole formed in a center thereof, the first stem being rockably supported relative to the housing; and a second stem slidably received by the guide hole and arranged to protrude from the first stem, the first and second stems being arranged such that a desired one of the peripheral fixed contacts may be brought into electrical communication with the common contact through the associated one of the movable contact springs by tilting the stems, and the central fixed contact may be brought into electrical communication with the central fixed contact by pushing the second stem.

9. A multidirectional switch according to claim 8 wherein each of the movable contact springs are substantially dome-shaped.

* * * * *